US008939531B2

(12) United States Patent
Govyadinov et al.

(10) Patent No.: US 8,939,531 B2
(45) Date of Patent: Jan. 27, 2015

(54) FLUID EJECTION ASSEMBLY WITH CIRCULATION PUMP

(75) Inventors: Alexander Govyadinov, Corvallis, OR (US); Jason Oak, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/819,893

(22) PCT Filed: Oct. 28, 2010

(86) PCT No.: PCT/US2010/054412

§ 371 (c)(1), (2), (4) Date: Feb. 28, 2013

(87) PCT Pub. No.: WO2012/057758

PCT Pub. Date: May 3, 2012

(65) Prior Publication Data

US 2013/0155135 A1 Jun. 20, 2013

(51) Int. Cl.

| | |
|---|---|
| ***B41J 29/38*** | (2006.01) |
| ***B41J 2/045*** | (2006.01) |
| ***B41J 2/165*** | (2006.01) |
| ***B41J 2/19*** | (2006.01) |
| ***B41J 2/14*** | (2006.01) |
| *B41J 2/18* | (2006.01) |

(52) U.S. Cl.

CPC ..... *B41J 2/04541* (2013.01); *B41J 2/165* (2013.01); *B41J 2/19* (2013.01); *B41J 2/14129* (2013.01); *B41J 2/16526* (2013.01); *B41J 2/18* (2013.01); *B41J 2002/14387* (2013.01); *B41J 2002/14467* (2013.01)

USPC ..... 347/9

(58) Field of Classification Search

CPC ..... B41J 2/19; B41J 2/165; B41J 2/1652; B41J 2/16526; B41J 2/17596

See application file for complete search history.

(56) References Cited

U.S. PATENT DOCUMENTS

| | | | |
|---|---|---|---|
| 4,318,114 | A | 3/1982 | Huliba |
| 5,412,411 | A | 5/1995 | Anderson |
| 5,818,485 | A | 10/1998 | Rezanka |
| 6,152,559 | A | 11/2000 | Kojima |
| 6,244,694 | B1 | 6/2001 | Weber et al. |
| 6,283,718 | B1 | 9/2001 | Prosperetti et al. |
| 6,631,983 | B2 | 10/2003 | Romano, Jr. et al. |
| 6,655,924 | B2 | 12/2003 | Ma |
| 6,953,236 | B2 | 10/2005 | Silverbrook |
| 7,204,585 | B2 | 4/2007 | Bruinsma et al. |
| 2013/0083136 | A1 * | 4/2013 | Govyadinov et al. ..... 347/85 |

FOREIGN PATENT DOCUMENTS

| | | |
|---|---|---|
| JP | 2001205810 | 7/2001 |
| JP | 2006272614 | 10/2006 |
| JP | 2008162270 | 7/2008 |

OTHER PUBLICATIONS

Inkjet Photo Printers, Ink, Paper, and Laser Toner Tool; InkJet Printers Paper Reviews; inkjethelper.com.

* cited by examiner

*Primary Examiner* — Julian Huffman

(57) ABSTRACT

A fluid ejection assembly includes a fluid slot, a recirculation channel, and a drop ejection element within the recirculation channel. A pump element is configured to pump fluid to and from the fluid slot through the recirculation channel. A first addressable drive circuit associated with the drop ejection element and a second addressable drive circuit associated with the pump element are capable of driving the drop ejection element and the pump element simultaneously.

13 Claims, 5 Drawing Sheets

FLUID EJECTION ASSEMBLY WITH CIRCULATION PUMP

BACKGROUND

Fluid ejection devices in inkjet printers provide drop-on-demand ejection of fluid drops. In general, inkjet printers print images by ejecting ink drops through a plurality of nozzles onto a print medium, such as a sheet of paper. The nozzles are typically arranged in one or more arrays, such that properly sequenced ejection of ink drops from the nozzles causes characters or other images to be printed on the print medium as the printhead and the print medium move relative to each other. In a specific example, a thermal inkjet printhead ejects drops from a nozzle by passing electrical current through a heating element to generate heat and vaporize a small portion of the fluid within a firing chamber. In another example, a piezoelectric inkjet printhead uses a piezoelectric material actuator to generate pressure pulses that force ink drops out of a nozzle.

Although inkjet printers provide high print quality at reasonable cost, continued improvement relies on overcoming various challenges that remain in their development. For example, during periods of storage or non-use, the nozzles in inkjet printheads can develop crust and/or viscous ink plugs in the bore area. Viscous plugs or solid film-like crust in the nozzle bore area can form as a result of ink drying and ink component consolidation. The plug or crust prevents a drop from firing when the nozzle ejection element is actuated. Other challenges that continue to adversely impact print quality and cost in inkjet printers include air bubble management and pigment-ink vehicle separation (PIVS) in printheads, which can cause ink flow blockage, ink leaks due to drooling, partly full print cartridges to appear to be empty, and general print quality degradation.

BRIEF DESCRIPTION OF THE DRAWINGS

The present embodiments will now be described, by way of example, with reference to the accompanying drawings, in which.

DETAILED DESCRIPTION

Overview of Problem and Solution

Figure 1:
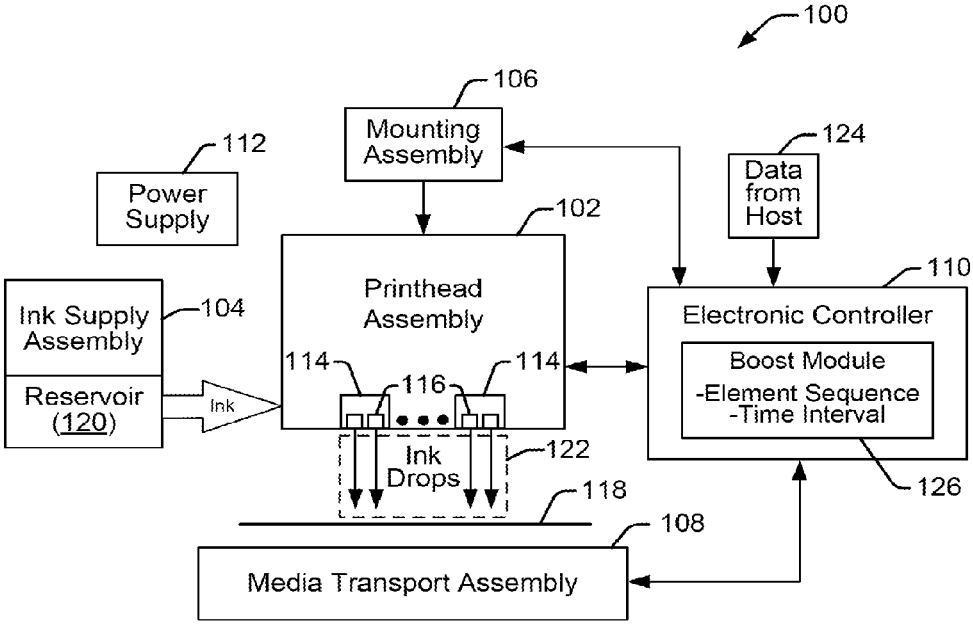
FIG. 1 illustrates a fluid ejection device embodied as an inkjet printing system that is suitable for incorporating a fluid ejection assembly, according to an embodiment.

As noted above, various challenges have yet to be overcome in the development of inkjet printing systems. For example, inkjet printheads used in such systems continue to have troubles with ink blockage and/or clogging. Causes for ink blockage and/or clogging include the development of viscous plugs and crust in the nozzle bore area that form as a result of ink drying and ink component consolidation, for example, during periods of storage or non-use. Other causes include air bubbles and pigment-ink vehicle separation (PIVS) in printheads.

Previous solutions to such problems have primarily involved servicing the printheads before and after their use. For example, printheads are typically capped during non-use to prevent nozzles from clogging with dried ink. Capping provides a favorable atmosphere around the printhead and in the nozzles that helps prevent ink from drying, which reduces the risk of crusting and ink plug formation in the nozzles. Prior to their use, nozzles are also primed by spitting ink through them. Spitting is the ejection of ink into a spittoon in a service station. Spitting helps prevent ink in nozzles that have not been fired for some time from drying and crusting. Drawbacks to these solutions include delays in printing due to the necessary servicing time at printer startup that prevents immediate printing, and an increase in the total cost of ownership due to the significant amount of ink consumed during servicing.

Other more recent methods of dealing with problems such as viscous ink plugs, crusting, air bubbles, and PIVS, involve micro-recirculation of ink through on-die ink-recirculation. For example, one micro-recirculation technique applies sub-TOE (turn on energy) pulses to nozzle firing resistors to induce ink recirculation without firing (i.e., without turning on) the nozzle. This technique has some drawbacks including the risk of puddling ink onto the nozzle layer. Another micro-recirculation technique includes on-die ink-recirculation architectures that implement auxiliary pump elements to improve nozzle reliability through ink recirculation. Although such micro-recirculation architectures go a long way toward improving problems with air bubble management and PIVS within inkjet printheads, there is still usually some dead volume in the nozzle bore area that is not completely affected by ink mixing in the chamber when using the recirculation architecture. Thus, the problem of viscous ink plugs and/or crusting in the nozzle bore area can persist.

Embodiments of the present disclosure improve on prior solutions to the problems of viscous ink plugs and crusting, generally by using the pump element in a micro-recirculation architecture to provide an energy boost to the fluid drop being ejected from the printhead nozzle. The energy boost increases the drop volume and speed which helps to overcome viscous ink plugs and/or crusting in the nozzle bore area. The sequencing and timing of activating the drop ejection element and the recirculation pump element relative to one another are controllable to achieve the energy boost. The controlled activation of the micro-recirculation pump element with respect to the drop ejection element for viscous ink plug and crust removal enhances the prior functionality of the micro-recirculation architecture, which includes prevention of pigment-ink vehicle separation (PIVS), air bubble management, improved decap time, and decreased ink consumption during servicing and priming.

In one example embodiment, a fluid ejection assembly includes a fluid slot, a recirculation channel and a drop ejection element within the recirculation channel. A pump element is configured to pump fluid (e.g., ink) to and from the fluid slot through the recirculation channel. A first addressable drive circuit associated with the drop ejection element and a second addressable drive circuit associated with the pump element are capable of driving the drop ejection element and pump element simultaneously. In another embodiment, a method of operating a fluid ejection assembly includes, within a fluid recirculation channel of a fluid ejection assembly, activating a drop ejection element to eject a fluid drop from a drop generator, and increasing the ejection energy to the fluid drop by activating a pump element. Increasing the ejection energy includes activating the pump element first, and then activating the drop ejection element within a programmable time interval of activating the pump element. In another embodiment, a fluid ejection device includes a fluid ejection assembly having a drop ejection element and a pump element within a recirculation channel, an electronic controller, and a drop energy boost module executable on the electronic controller to activate the drop ejection element within a time interval of activating the pump element.

Illustrative Embodiments

FIG. 1 illustrates a fluid ejection device embodied as an inkjet printing system 100 that is suitable for incorporating a fluid ejection assembly as disclosed herein, according to an embodiment of the disclosure. In this embodiment, the fluid ejection assembly is disclosed as a fluid drop jetting printhead 114. Inkjet printing system 100 includes an inkjet printhead assembly 102, an ink supply assembly 104, a mounting assembly 106, a media transport assembly 108, an electronic printer controller 110, and at least one power supply 112 that provides power to the various electrical components of inkjet printing system 100. Inkjet printhead assembly 102 includes at least one fluid ejection assembly 114 (printhead 114) that ejects drops of ink through a plurality of orifices or nozzles 116 toward a print medium 118 so as to print onto print media 118. Print media 118 is any type of suitable sheet or roll material, such as paper, card stock, transparencies, Mylar, and the like. Typically, nozzles 116 are arranged in one or more columns or arrays such that properly sequenced ejection of ink from nozzles 116 causes characters, symbols, and/or other graphics or images to be printed upon print media 118 as inkjet printhead assembly 102 and print media 118 are moved relative to each other.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a macro-recirculating ink delivery system. In a one-way ink delivery system, substantially all of the ink supplied to inkjet printhead assembly 102 is consumed during printing. In a macro-recirculating ink delivery system, however, only a portion of the ink supplied to printhead assembly 102 is consumed during printing. Ink not consumed during printing is returned to ink supply assembly 104.

In one embodiment, inkjet printhead assembly 102 and ink supply assembly 104 are housed together in an inkjet cartridge or pen. In another embodiment, ink supply assembly 104 is separate from inkjet printhead assembly 102 and supplies ink to inkjet printhead assembly 102 through an interface connection, such as a supply tube. In either embodiment, reservoir 120 of ink supply assembly 104 may be removed, replaced, and/or refilled. In one embodiment, where inkjet printhead assembly 102 and ink supply assembly 104 are housed together in an inkjet cartridge, reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 106 positions inkjet printhead assembly 102 relative to media transport assembly 108, and media transport assembly 108 positions print media 118 relative to inkjet printhead assembly 102. Thus, a print zone 122 is defined adjacent to nozzles 116 in an area between inkjet printhead assembly 102 and print media 118. In one embodiment, inkjet printhead assembly 102 is a scanning type printhead assembly. As such, mounting assembly 106 includes a carriage for moving inkjet printhead assembly 102 relative to media transport assembly 108 to scan print media 118. In another embodiment, inkjet printhead assembly 102 is a non-scanning type printhead assembly. As such, mounting assembly 106 fixes inkjet printhead assembly 102 at a prescribed position relative to media transport assembly 108. Thus, media transport assembly 108 positions print media 118 relative to inkjet printhead assembly 102.

Electronic printer controller 110 typically includes a processor, firmware, software, one or more memory components including volatile and no-volatile memory components, and other printer electronics for communicating with and controlling inkjet printhead assembly 102, mounting assembly 106, and media transport assembly 108. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one embodiment, electronic printer controller 110 controls inkjet printhead assembly 102 for ejection of ink drops from nozzles 116. Thus, electronic controller 110 defines a pattern of ejected ink drops which form characters, symbols, and/or other graphics or images on print media 118. The pattern of ejected ink drops is determined by the print job commands and/or command parameters. In one embodiment, electronic controller 110 includes energy boost module 126 stored in a memory of controller 110. Boost module 126 executes on electronic controller 110 (i.e., a processor of controller 110) to control the activation sequence of nozzle ejection elements and pump elements within a fluid ejection assembly 114, as well as the time interval between such activations. Thus, boost module 126 includes a programmable element sequence component and a programmable time interval component.

In one embodiment, inkjet printhead assembly 102 includes one fluid ejection assembly (printhead) 114. In another embodiment, inkjet printhead assembly 102 is a wide array or multi-head printhead assembly. In one wide-array embodiment, inkjet printhead assembly 102 includes a carrier that carries fluid ejection assemblies 114, provides electrical communication between fluid ejection assemblies 114 and electronic controller 110, and provides fluidic communication between fluid ejection assemblies 114 and ink supply assembly 104.

In one embodiment, inkjet printing system 100 is a drop-on-demand thermal bubble inkjet printing system wherein the fluid ejection assembly 114 is a thermal inkjet (TIJ) printhead. The thermal inkjet printhead implements a thermal resistor ejection element in an ink chamber to vaporize ink and create bubbles that force ink or other fluid drops out of a nozzle 116.

Figure 2:
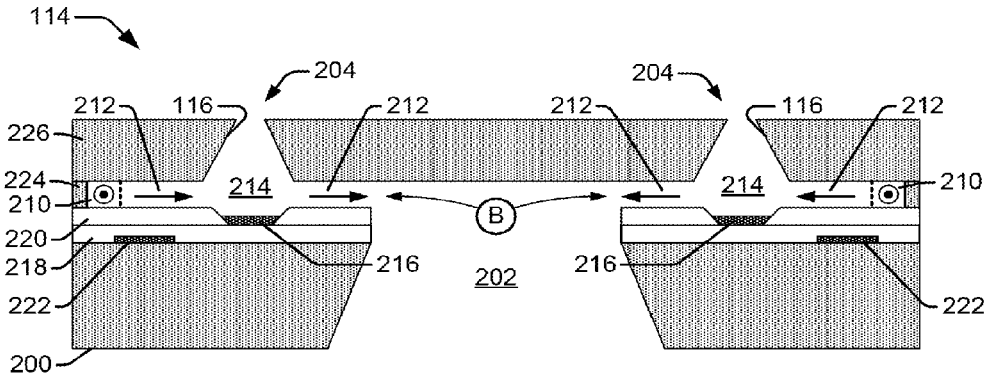
FIG. 2 shows a cross-sectional view of a fluid ejection assembly cut through a drop generator and outlet channel, according to an embodiment.
Figure 3:
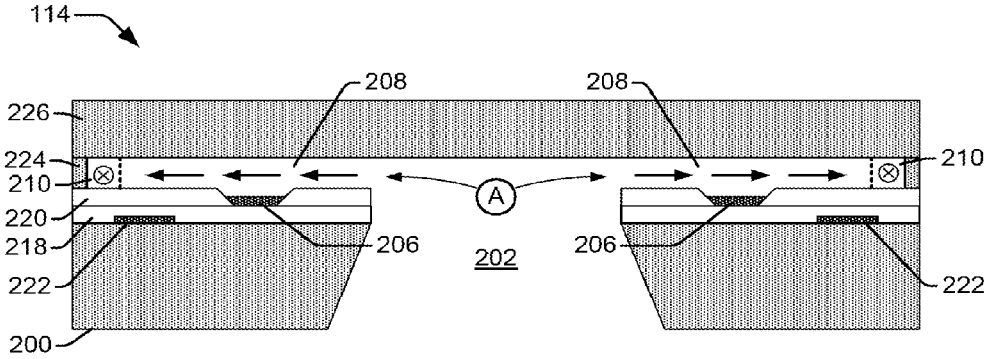
FIG. 3 shows a cross-sectional view of a fluid ejection assembly cut through a fluid pump element and inlet channel, according to an embodiment.
Figure 4:
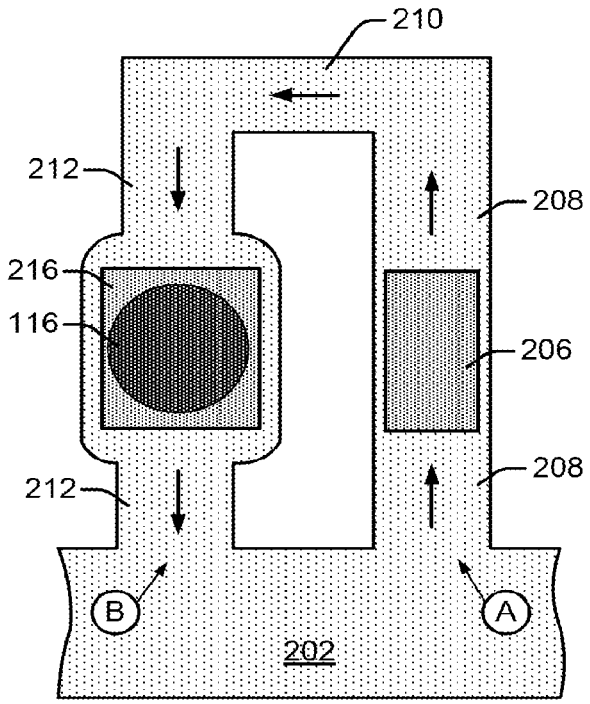
FIG. 4 shows a partial top-down view of micro-recirculation architecture within a fluid ejection assembly having a single recirculation channel and pump element, and a single ejection element, according to an embodiment.
Figure 5:
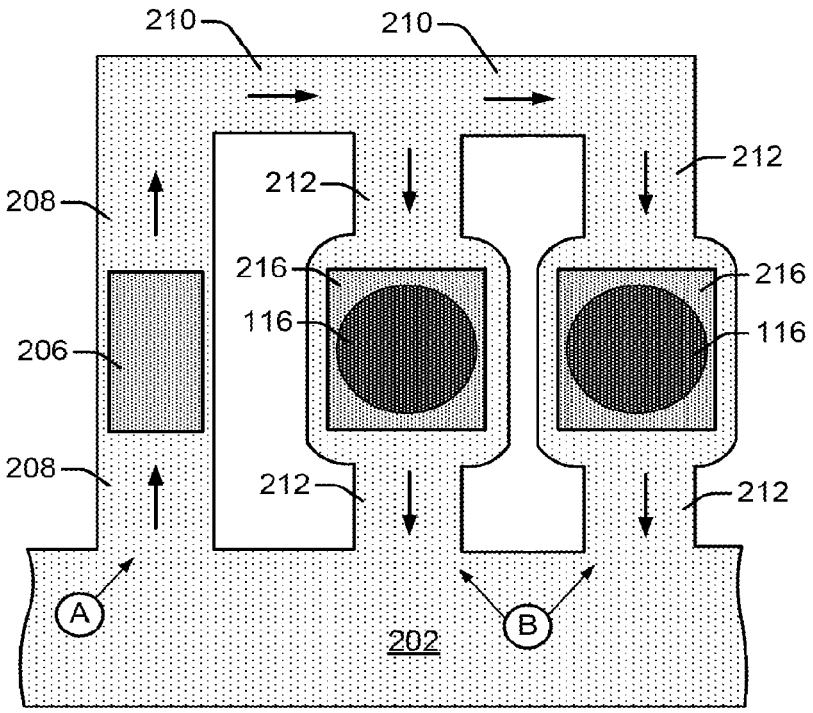
FIG. 5 shows a partial top-down view of micro-recirculation architecture within a fluid ejection assembly having a single pump element and multiple ejection elements with respective recirculation channels, according to an embodiment.

FIGS. 2 and 3 show cross-sectional views of a fluid ejection assembly 114, according to an embodiment of the disclosure. FIG. 2 shows a cross-sectional view of the fluid ejection assembly 114 cut through a drop generator and outlet channel, while FIG. 3 shows a cross-sectional view of the fluid ejection assembly 114 cut through a fluid pump element and inlet channel. FIGS. 4 and 5 show partial top-down views of micro-recirculation architectures within fluid ejection assemblies 114, according to embodiments of the disclosure. FIG. 4 illustrates an embodiment in which there is a single recirculation channel and pump element 206 to circulate fluid to each ejection element 216. FIG. 5 illustrates an embodiment in which there is a single pump element 206 to circulate fluid to two ejection elements 216 through two respective recirculation channels. These embodiments are shown by way of example only, and other embodiments that include greater numbers of recirculation channels and ejection elements 216 per pump element 206 are possible.

Referring generally to FIGS. 2, 3, 4, and 5, the fluid ejection assembly 114 includes a substrate 200 with a fluid slot 202 formed therein. The fluid slot 202 is an elongated slot extending into the plane of FIG. 2 that is in fluid communication with a fluid supply (not shown), such as a fluid reservoir 120. In general, fluid from fluid slot 202 circulates through drop generators 204 based on flow induced by a fluid pump element 206. As indicated by the black direction arrows in FIGS. 2-5, the pump element 206 pumps fluid from the fluid slot 202 through a fluid recirculation channel. The recirculation channel includes an inlet channel 208, connection channel 210, and an outlet channel 212. The recirculation channel begins at the fluid slot 202 and runs first through the inlet channel 208 that contains the pump element 206 which is located generally toward the beginning of the recirculation channel. The recirculation channel then continues through the connection channel 210. The recirculation channel then runs through an outlet channel 212 containing a drop generator 204, and is completed upon returning back to the fluid slot 202. Note that the direction of flow through connection channel 210 is indicated by a circle with a cross (flow going into the plane) in FIG. 3 and a circle with a dot (flow coming out of the plane) in FIG. 2. However, these flow directions are shown by way of example only, and in various pump configurations and depending on where a particular cross-sectional view cuts across the fluid ejection assembly 114, the directions may be reversed.

Referring still to FIGS. 2-5, the exact location of the fluid pump element 206 within the inlet channel 208 may vary somewhat, but in any case will be asymmetrically located with respect to the center point of the length of the recirculation channel. For example, the approximate center point of the recirculation channel is located somewhere in the connection channel 210 of FIGS. 2-5, since the recirculation channel begins in the fluid slot 202 at point "A", extends through the inlet channel 208, the connection channel 210, and the outlet channel 212, and then ends back in the fluid slot 202 at point "B". Therefore, the asymmetric location of the fluid pump 206 within the inlet channel 208 creates a short side of the recirculation channel between the pump 206 and the fluid slot 202, and a long side of the recirculation channel that extends from the pump 206 through the outlet channel 212 and back to the fluid slot 202. The asymmetric location of the fluid pump 206 at the short side of the recirculation channel is the basis for the fluidic diodicity within the recirculation channel that results in a net fluid flow in a forward direction toward the long side of the recirculation channel and outlet channel 212 as indicated by the black direction arrows.

Drop generators 204 are arranged on either side of the fluid slot 202 and along the length of the slot extending into the plane of FIG. 2. Each drop generator 204 includes a nozzle 116, an ejection chamber 214, and an ejection element 216 disposed within the chamber 214. Drop generators 204 (i.e., the nozzles 116, chambers 214, and ejection elements 216) are organized into groups referred to as primitives 600 (FIG. 6), wherein each primitive 600 comprises a group of adjacent ejection elements 216. A primitive 600 typically includes a group of twelve drop generators 204, but may include different numbers such as six, eight, ten, fourteen, sixteen, and so on.

Ejection element 216 can be any device capable of operating to eject fluid drops through a corresponding nozzle 116, such as a thermal resistor or piezoelectric actuator. In the illustrated embodiment, the ejection element 216 and the fluid pump 206 are thermal resistors formed of an oxide layer 218 on a top surface of the substrate 200 and a thin film stack 220 applied on top of the oxide layer 218. The thin film stack 220 generally includes an oxide layer, a metal layer defining the ejection element 216 and pump 206, conductive traces, and a passivation layer. Although the fluid pump 206 is discussed as a thermal resistor element, in other embodiments it can be any of various types of pumping elements that may be suitably deployed within an inlet channel 208 of a fluid ejection assembly 114. For example, in different embodiments fluid pump 206 might be implemented as a piezoelectric actuator pump, an electrostatic pump, an electro hydrodynamic pump, etc.

Also formed on the top surface of the substrate 200 is additional integrated circuitry 222 for selectively activating each ejection element 216 and fluid pump element 206. The additional circuitry 222 includes a drive transistor such as a field-effect transistor (FET), for example, associated with each ejection element 216. While each ejection element 216 has a dedicated drive transistor to enable individual activation of each ejection element 216, each pump 206 may not have a dedicated drive transistor because pumps 206 do not generally need to be activated individually. Rather, a single drive transistor typically powers a group of pumps 206 simultaneously. The fluid ejection assembly 102 also includes a chamber layer 224 having walls and chambers 214 that separate the substrate 200 from a nozzle layer 226 having nozzles 108.

Figure 6:
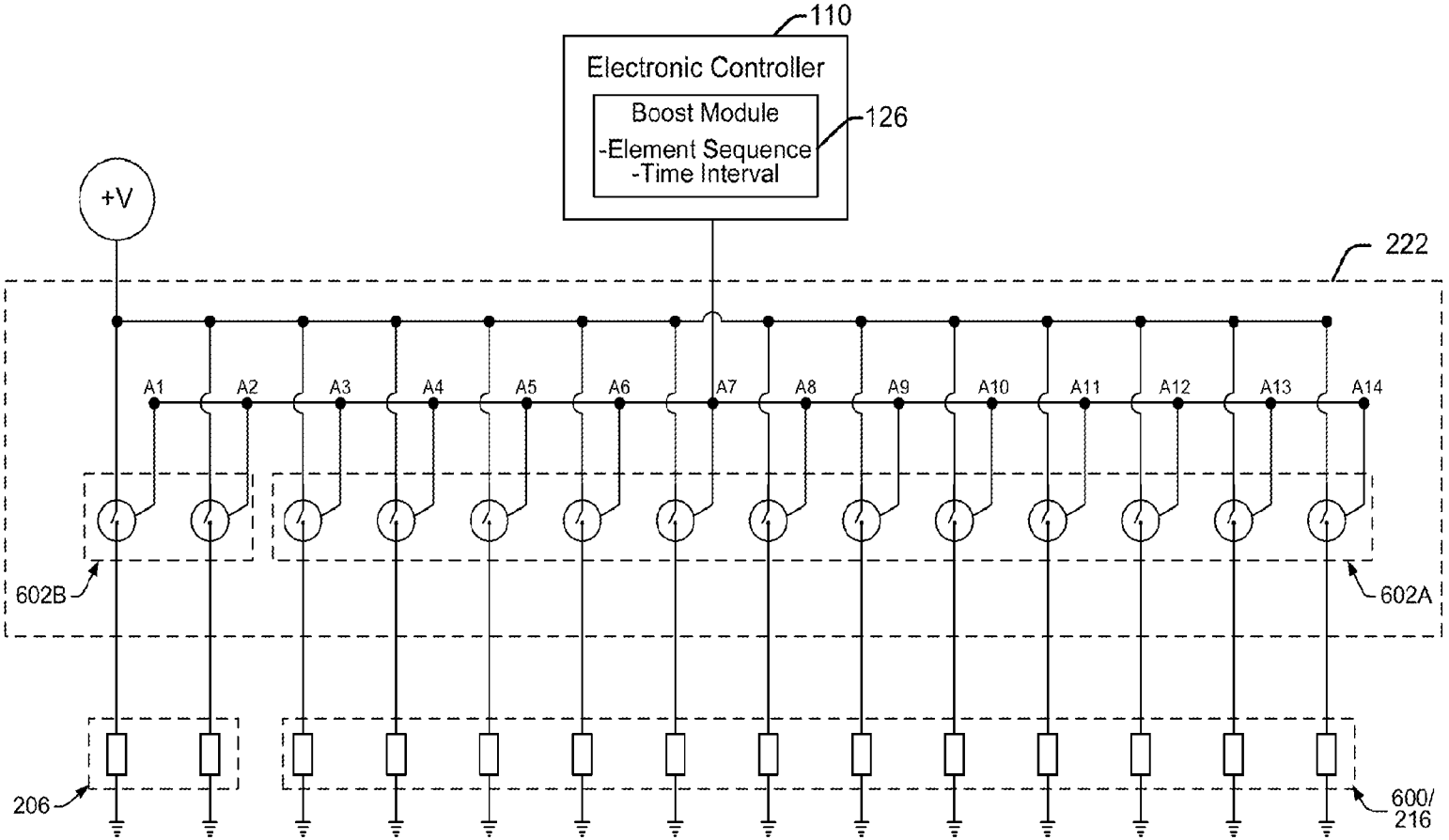
FIG. 6 shows a block diagram illustrating additional integrated circuitry on the substrate of a fluid ejection assembly, according to an embodiment.

FIG. 6 shows a block diagram illustrating additional integrated circuitry 222 on the substrate 200 of a fluid ejection assembly 114, according to an embodiment of the disclosure. The additional integrated circuitry 222 in a fluid ejection assembly 114 includes individually addressable drive circuits 602 (e.g., addresses A1-A14) configured to activate ejection elements 216 and pump elements 206 in response to control signals received from an electronic controller 110. The addressable drive circuits 602 include nozzle ejector element drive circuits 602A that control activation of nozzle ejector elements 216, and pump element drive circuits 602B that control activation of pump elements 206. In the embodiment of FIG. 6, a primitive 600 includes twelve nozzles with ejection elements 216 and two pump elements 206. In such an arrangement, each pump element 206 circulates fluid to six ejection elements 216 through six respective recirculation channels in a manner similar to that shown in the FIG. 5 embodiment.

Figure 7:
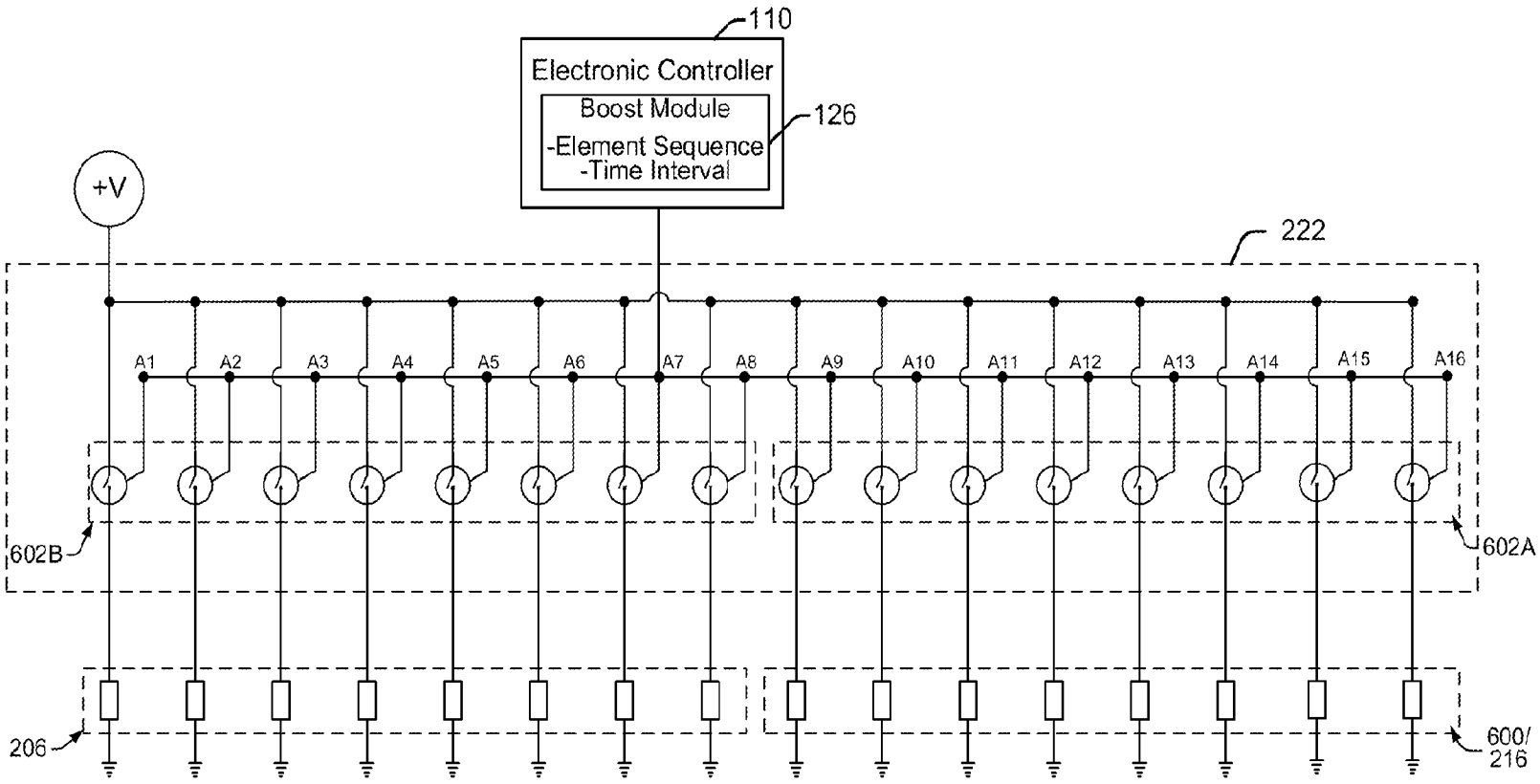
FIG. 7 shows a block diagram illustrating additional integrated circuitry on the substrate of a fluid ejection assembly with a dedicated drive circuit supporting each individual pump element, according to an embodiment.

FIG. 7 shows a block diagram illustrating additional integrated circuitry 222 on the substrate 200 of a fluid ejection assembly 114, where a dedicated drive circuit (e.g., a drive transistor such as a field-effect transistor (FET)) supports each individual pump element 206, according to an embodiment of the disclosure. In this embodiment, there are eight pump elements 206 and eight ejection elements 216 per primitive 600. In this arrangement, each pump element 206 circulates fluid to a single ejection element 216 through a single recirculation channel in a manner similar to that shown in the embodiment of FIG. 4 discussed above.

Referring now to FIGS. 6 and 7, and as noted above with respect to FIG. 1, boost module 126 is executable on one or more processing components of electronic controller 110 to control the activation sequence of nozzle ejection elements 216 and pump elements 206 within a fluid ejection assembly 114, and to control the time interval between such activations. Such control enables the transmission of additional energy to fluid drops being ejected from nozzles 116 which is helpful in overcoming viscous ink plugs and/or crust that may have developed in the nozzles 116. Boost module 126 includes a programmable "element sequence" component and "time interval" component that enable electronic controller 110 to control the individually addressable drive circuits 602 (i.e., 602A and 602B). Thus, through the individually addressable drive circuits 602, the boost module 126 enables electronic controller 110 to adjust the sequence of activation of the nozzle ejection elements 216 within a primitive 600, and the associated pump elements 206. In addition, the time interval between activation of the pump elements 206 and ejection elements 216 can be precisely controlled.

In general, to achieve beneficial drop energy boost that will overcome viscous ink plugs and/or crust that has developed in a nozzle 116, the pump element 206 is activated just prior to activating the associated nozzle ejection element 216 or simultaneously with activating the associated nozzle ejection element 216. Activating the pump element 206 causes fluidic movement in the recirculation channel that imparts an additional boost of energy to the fluid drop generated when the ejection element 216 is activated. In one example embodiment, a beneficial value for a time interval is 2 micro-seconds or less. Thus, referring to the FIG. 6 embodiment, electronic controller 110 provides an activation signal to a pump element drive circuit 602B, such as the drive circuit 602B at address "A1", followed shortly thereafter (i.e., less than 2 micro-seconds) with an activation signal to a nozzle ejector drive circuit 602A, such as the drive circuit 602A at address "A5". Note that in the FIG. 7 embodiment, an activation signal to pump element drive circuit 602B at address "A1" would be followed by an activation signal to a nozzle ejector drive circuit 602A at an address such as "A9", depending on which pump element 206 is associated with which nozzle ejection element 216. In another example embodiment, the time interval is zero. Thus, referring to embodiments in both FIG. 6 and FIG. 7, the electronic controller 110 provides an activation signal to a pump element drive circuit 602B (e.g., at address "A2") and to an ejection element drive circuit 602A (e.g., at address "A13") at the same time, causing the simultaneous activation of a pump element 206 and associated ejection element 216. Simultaneous activation of pump element 206 and an associated ejection element 216 has also been shown to achieve beneficial drop energy boost.

Although particular examples of time intervals have been discussed, beneficial drop energy boost can also be achieved using different time intervals between the activation of the pump element 206 and a nozzle ejection element 216. Thus, time intervals that are greater or lesser than 2 micro-seconds, for example, are contemplated. Such time intervals are dependant at least in part on the various dimensional geometries possible within the micro-recirculation architecture of the fluid ejection assembly 114.

What is claimed is:

1. A fluid ejection assembly comprising:
- a fluid slot;
- a recirculation channel;
- a drop ejection element within the recirculation channel;
- a pump element to pump fluid to and from the fluid slot through the recirculation channel; and
- a first addressable drive circuit associated with the drop ejection element and a second addressable drive circuit associated with the pump element, the drive circuits capable of driving the drop ejection element and the pump element simultaneously and configured to receive signals from a controller to activate the drop ejection element and pump element within a programmed time interval of one another.

2. A fluid ejection assembly as in claim 1, comprising multiple recirculation channels, each recirculation channel including a drop ejection element and each drop ejection element having a separately addressable drive circuit.

3. A fluid ejection assembly as in claim 1, further comprising a drop generator, the drop generator including the drop ejection element and a firing chamber.

4. A fluid ejection assembly as in claim 1, wherein the drop ejection element and the pump element are selected from the group consisting of a thermal resistor and a piezoelectric actuator.

5. A fluid ejection assembly as in claim 1, wherein the recirculation channel comprises:
- an inlet channel;
- an outlet channel; and
- a connection channel.

6. A fluid ejection assembly as in claim 5, wherein the inlet channel comprises the pump element and the outlet channel comprises the drop ejection element.

7. A method of operating a fluid ejection assembly, comprising:
- within a fluid recirculation channel of a fluid ejection assembly:
  - activating a drop ejection element to eject a fluid drop from a drop generator; and,
  - increasing ejection energy to the fluid drop by activating a pump element first, and activating the drop ejection element within a programmable time interval of activating the pump element.

8. A method as in claim 7, wherein the programmable time interval is zero, such that the drop ejection element and the pump element are activated simultaneously.

9. A method as in claim 7, wherein the programmable time interval is two micro-seconds, such that the drop ejection element is activated less than two micro-seconds after the pump element is activated.

10. A method as in claim 7, wherein activating the drop ejection element comprises receiving an activation signal at an addressable ejection drive circuit associated with the drop ejection element, and activating the pump element comprises receiving an activation signal at an addressable pump drive circuit.

11. A method as in claim 10, wherein receiving an activation signal comprises receiving an activation signal from a controller executing a drop energy boost module having a programmable time interval to control an amount of time between activating the pump element and activating the drop ejection element.

12. A fluid ejection device, comprising:

a fluid ejection assembly having a drop ejection element and a pump element within a recirculation channel;

an electronic controller; and a drop energy boost module executable on the electronic controller to activate the drop ejection element within a time interval of activating the pump element.

13. A fluid ejection device as in claim 12, further comprising:

a programmable time interval component of the boost module to enable the electronic controller to adjust the time interval; and a programmable element sequence component of the boost module to enable the electronic controller to adjust an activation sequence of drop ejection elements within a nozzle primitive.

* * * * *